US005108887A

United States Patent [19]

Fabricius et al.

[11] Patent Number: 5,108,887

[45] Date of Patent: Apr. 28, 1992

[54] ZEROMETHINE MEROCYANINE DYES AS J-AGGREGATING SPECTRAL SENSITIZERS FOR TABULAR EMULSIONS

[75] Inventors: Dietrich M. Fabricius; James J. Welter, both of Hendersonville, N.C.

[73] Assignee: E. I. du Pont de Nemours and Company, Wilmington, Del.

[21] Appl. No.: 623,260

[22] Filed: Dec. 5, 1990

Related U.S. Application Data

[63] Continuation of Ser. No. 412,536, Sep. 22, 1989, abandoned, which is a continuation of Ser. No. 158,185, Feb. 12, 1988, abandoned.

[51] Int. Cl.[5] ..... G03C 1/10

[52] U.S. Cl. ..... 430/567; 430/591; 430/961

[58] Field of Search ..... 430/567, 591, 592, 577, 430/961

[56] References Cited

U.S. PATENT DOCUMENTS

| | | | |
|---|---|---|---|
| 3,734,739 | 5/1973 | Borror | 96/132 |
| 4,028,353 | 6/1977 | Borror | 260/240.6 |
| 4,425,426 | 1/1984 | Abbott et al. | 430/502 |
| 4,729,946 | 3/1988 | Kasama et al. | 430/567 |

FOREIGN PATENT DOCUMENTS 105425 4/1984 European Pat. Off. .

*Primary Examiner*—Charles L. Bowers, Jr.
*Assistant Examiner*—Janet C. Baxter

[57] ABSTRACT

A special group of zeromethine dyess which are desensitizers for sherical grain emulsions but which J-aggregate on tabular grains is described. Tabular emulsions containing these dyes are particularly useful as X-ray elements since the maximum emission peak of the dyes present therein closely matches the ouput of intensifying screens used therewith.

8 Claims, No Drawings

ZEROMETHINE MEROCYANINE DYES AS J-AGGREGATING SPECTRAL SENSITIZERS FOR TABULAR EMULSIONS

This application is a continuation of application Ser. No. 07/412,536 filed Sep.22, 1989, now abandoned, which is a continuation of Ser. No. 07/158,185 filed Feb. 19, 1988, now abandoned.

FIELD OF THE INVENTION

This invention relates to photographic silver halide emulsions and to dyes which can be used to enhance the spectral sensitivity thereof. Still more particularly, this invention relates to emulsions composed mainly of tabular silver halide grains and a particular group of dyes which J-aggregate on said tabular silver halide grains.

BACKGROUND OF THE INVENTION

Emulsions which contain essentially tabular silver halide grains are well known in the prior art. These grains provide some advantages over more conventional, spherical grains. For example, silver halide X-ray elements containing tabular grains can be fully forehardened and yet maintain excellent covering power. This is an advantage over conventional X-ray elements containing spherical grains which are normally hardened during the processing steps. Additionally, tabular grains can be coated at a lower coating weight and thus have a silver savings over elements containing conventional grains. Also, elements containing tabular grains sometimes exhibit a higher speed than those with spherical grains. However, since tabular grains have low sensitivity to blue light, there is a pressing need to provide satisfactory spectral sensitizing dyes therefor and thus be able to use all the advantages provided by these tabular grains. Spectral sensitizing dyes reported in the prior art used mainly for spherical grains, can also be used with tabular grain elements. However, they generally must be used at high levels when incorporated with silver halide grains and this can lead to undesirable stain, fog and processing artifacts. Stain is particularly unsatisfactory when present in X-ray elements, for example. Here, it is conventional to use a blue-tinted film support. Conventional dyes when used with tabular containing silver halide elements tend to leave a yellow or muddy brown color and this is particularly objectionable for this use.

Spectral sensitizing dyes which J-aggregate are also well known in the prior art. J-aggregation causes a single dye, or a mixture of dyes, to shift the absorption maxima to a longer wavelength. Dyes which J-aggregate are of major practical importance since they are sharp and have high absorption coefficients giving selective sensitization. Although a number of dyes have been reported as being particularly useful with tabular grains, few or none appear to possess the ability to J-aggregate thereon in the 400 to 500 nm spectral range.

SUMMARY OF THE INVENTION

It is an object of this invention to provide spectral sensitizers for silver halide elements which contain essentially tabular grains. It is another object of this invention to provide spectral sensitizers which can J-aggregate and provide increased spectral efficiency in the 400 to 500 nm range. A still further object is to provide a tabular silver halide X-ray element which has good spectral efficiency and low residual dye stain. These and yet other objects are achieved in a photographic element comprising a support having at least one photosensitive emulsion coated thereon, said emulsion comprising silver halide grains wherein at least 50% of said grains are tabular silver halide grains with a thickness of of less than 0.5 microns, preferably with a thickness of about 0.1 to 0.2 microns, and an average aspect ratio of greater than 2:1, dispersed in a binder, the improvement comprising incorporation into said emulsion at least one J-aggregating spectral sensitizing dye of the formula:

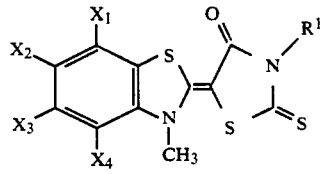

wherein X1–4 independently of the other is halogen, methoxy, hydrogen, trifluoromethyl, or alkyl of 1–3 carbon atoms and R′ is methyl allyl, $CH_2CO_2H$—N$(CH_2CH_3)_3$, $CH_2CH_2$—$SO_3H$, $CH_2$—$CO_2H$, $(CR''_2)_n$—$CO_2H$, wherein n is 1–5, and R″ is H or alkyl of 1–5 carbon atoms, and salts thereof.

DETAILED DESCRIPTION OF THE INVENTION

A class of zeromethine merocyanine dyes incorporated in a silver halide emulsion according to the teachings of this invention appear to J-aggregate and sensitize tabular silver halide grains contained therein at about 465 nm. Since most of the energy given off during an X-ray exposure does not expose the silver halide films associated therewith. X-ray film elements are conventionally used with intensifying screens. In this case, the phosphor of the conventional intensifying screen absorbs the X-ray energy and then emits a blue light which is then used to expose the silver halide film. Since some more modern X-ray intensifying screens emit light in the 400–500 nm region, the dyes of this invention are particularly useful therewith. When these dyes are added to emulsions containing mainly spherical grains, they appear to desensitize the emulsion. Thus, it was surprising that the effects described above were noted in tabular type emulsions. Examples of specific dye structures useful within the ambit of this invention are as follows in accordance with the formula presented under the Summary of the Invention:

(Compounds 5, 6 and 9 are preferred).

| No. | R′ | $X_3$ | MW | MP (°C.) | Abs. Max (nm) | Ext. Coef $X10^{-4}$ |
|---|---|---|---|---|---|---|
| 1 | H | H | 280 | 280–281 | 423 | 7.1 |
| 2 | $CH_3$ | H | 294 | 309–312 | 424 | 5.5 |
| 3 | $CH_2$—$CH_2$ | H | 308 | 273–275 | 425 | 6.4 |
| 4 | $CH_2$—CH=$CH_2$ | H | 320 | 252–254 | 425 | 8.6 |

-continued

| No. | R' | $X_3$ | MW | MP (°C.) | Abs. Max (nm) | Ext. Coef $X10^{-4}$ |
|---|---|---|---|---|---|---|
| 5 | $CH_2—CO_2H$ | H | 338 | 283-286 | 424 | 7.2 |
| 6 | $CH_2—CH_2—CO_2H—NEt_3$ | H | 453 | 286-288 | 423 | 8.2 |
| 7 | $CH_2—CH_2—SO_3H$ | H | 388 | 382-390 | 424 | 5.5 |
| 8 | $CH_2—CO_2H—NEt_3$ | $O—CH_3$ | 469 | 297-298 | 430 | 7.7 |
| 9 | $CH_2—CO_2H—NEt_3$ | Cl | 473 | 296-297 | 424 | 8.0 |
| 10 | $CH_2—CO_2H—NEt_3$ | $CF_3$ | 507 | 295-300 | 421 | 9.2 |
| 11 | $CH(CH_3)—CO_2H—NEt_3$ | H | 453 | 310-313 | 426 | 6.0 |

Note - In Nos. 1 to 11, $X_1$, $X_2$ and $X_4$ are H.

These dyes may be dissolved in any of a host of suitable solvents including phenylethanol, hexafluoroisopropanol, methyl sulfoxide, methanol, phenoxyethanol, etc. or mixtures of these with water, for example. The solutions containing these dyes are usually very dilute since the solubility of the dye is very low. Preferably, the dyes can be added as a concentrated slurry in the aforementioned solvents to the tabular grain emulsions, e.g., in an amount in the range 25 to 750 mg of dye per mole of silver bromide and preferably from 125 to 275 mg/mole. A solution of these dyes may also be employed. The dyes are preferably added to the tabular grain emulsions prior to chemical sensitization (e.g. prior to the addition of gold and sulfur salts, for example), although they may be added at any time during the preparation of the grains and prior to coating thereof.

Tabular grain silver halide products are well-known in the prior art and present the user with some considerable advantages over conventional grain products (e.g. semi-spheroidal grains, for example). The tabular products can usually be coated at a much thinner coating weight without loss of covering power. They are also more easily developed and can be hardened with greater amounts of conventional hardeners presenting quite an advantage over the conventional grains. Tabular chloride emulsions are also well-known and are described by Maskasky in U.S. Pat. No. 4,400,463, Aug. 23, 1983 and also by Wey. U.S. Pat. No. 4,399,205. Some other references which describe the manufacture and use of tabular grain elements are Dickerson, U.S. Pat. No. 4,414,304; Wilgus et al., U.S. Pat. No. 4,434,226; and Kofron et al., U.S. Pat. No. 4,439,520.

It is considered within the scope of this invention to use supersensitizing amounts of two dyes of this invention. For example, the following pairs within this invention can be employed:

Dye 5 (described below) with 5-[3-(3'-sulfobutyl)-2-benzothiazolinylidene]-3-carboxymethylrhodanine, triethylamine salt.

Dye 5 (described below) with 5-[3-(3'-sulfobutyl)-2-benzothiazolinylidene]-3-ethylrhodanine, triethylamine salt.

As employed herein the term "tabular" is defined as requiring that silver halide grains have a thickness of less than 0.5 micron (preferably less than 0.3 micron) and a diameter of at least 0.2 micron with an average aspect ratio of greater than 2:1. These silver halide grains will generally account for a least 50 percent of all silver halide grains present in the emulsion.

The grain characteristics described above of the silver halide emulsions of this invention can be readily ascertained by procedures well known to those skilled in the art. As employed herein, the term "aspect ratio" refers to the ratio of the diameter of the grain to its thickness. From shadowed electron micrographs of emulsion samples, it is possible to determine the thickness of each grain and calculate an average therefrom. The average diameter of the grains is in turn determined from their area by assuming that said area is the ratio of the median volume (as measured independently by a conventional Electrolytic Grain Size Analyzer-EGSA) and from the thickness as determined from the aforesaid electron micrograph described above. Thus, we can identify those tabular having a thickness of less than 0.5 micron (or preferably less than 0.3 micron) and a diameter of at least 0.2 micron. From this, the aspect ratio of each such tabular grain can be calculated, and the aspect ratios of all the tabular grains in the sample meeting the thickness and diameter criteria, can be averaged to obtain their average aspect ratio. By this definition the average aspect ratio is the average of individual tabular grains aspect ratios. In practice it is usually simpler to obtain an average thickness and an average diameter of the tabular grains having a thickness of less than 0.5 (or 0.3) micron and a diameter of at least 0.2 micron and to calculate the average aspect ratio as the ratio of these two averages. Whether the averaged individual aspect ratios or the averages of thickness and diameter are used to determined the average aspect ratio, within the tolerance of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter criteria can be calculated.

Any of the conventional halides may be used for the preparation of silver halide grains, but we prefer pure silver bromide or silver bromide with small amounts of iodide incorporated therein (e.g. 98% Br and 2% I by weight for example).

Particularly preferred processes for preparing tabular silver halide elements useful within the metes and bounds of this invention are contained in assignee's application Nottorf, Ser. No. 917,504, filed Oct. 10, 1986 and allowed Aug. 12, 1987, and in assignee's copending application Ellis, Ser. No. 917,505, filed Oct. 10, 1986. These teachings, which are incorporated herein by reference, describe processes by which high speed tabular silver halide grains may be made with a narrow grain size distribution. Other prior art processes for manufacture of such grains likewise are suitable.

After the tabular grains are made, they are usually dispersed with larger amounts of binder (e.g. gelatin or other well-known binders such as polyvinyl alcohol, phthalated gelatins, etc.). In place of gelatin other natural or synthetic water-permeable organic colloid binding agents can be used as a total or partial replacement thereof. Such agents include water permeable or water-soluble polyvinyl alcohol and its derivatives, e.g., partially hydrolyzed polyvinyl acetates, polyvinyl ethers, and acetals containing a large number of extralinear —$CH_2CHOH$— groups; hydrolyzed interpolymers of vinyl acetate and unsaturated addition polymerizable compounds such as maleic anhydride, acrylic and methacrylic acid ethyl esters, and styrene. Suitable colloids of the last mentioned types are disclosed in U.S. Pat. Nos. 2,276,322, 2,276,323 and 2,347,811. The useful polyvinyl acetals include polyvinyl acetalaldehyde acetal, polyvinyl butyraldehyde acetal and polyvinyl sodium o-sulfobenzaldehyde acetal. Other useful colloid binding agents include the poly-N-vinyllactams of Bolton, U.S. Pat. No. 2,495,918, the hydrophilic copolymers of N-acrylamido alkyl betaines described in Shacklett, U.S. Pat. No. 2,833,650 and hydrophilic cellulose ethers and esters. Phthalated gelatins may also be used as well as binder adjuvants useful for increasing covering power such as dextran or the modified, hydrolysed gelatins of Rakoczy, U.S. Pat. No. 3,778,278. As mentioned, these tabular silver halide emulsions may be chemically sensitized with salts of gold and sulfur as well known to those reasonably skilled in the art. Sulfur sensitizers include those which contain labile sulfur, e.g. allyl isothiocyanate, allyl diethyl thiourea, phenyl isothiocyanate and sodium thiosulfate for example. The polyoxyalkylene ethers in Blake et al., U.S. Pat. No. 2,400,532, and the polyglycols disclosed in Blake et al., U.S. Pat. No. 2,423,549. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used. Preferably, we add the J-aggregating spectral sensitizing dyes of this invention prior to the chemical sensitization step noted above, although these dyes may be added at any time during the emulsion manufacture and before coating on a support.

The emulsions can contain known antifoggants, e.g. 6-nitrobenzimidazole, benzotriazole, triazaindenes, etc., as well as the usual hardeners, i.e., chrome alum, formaldehyde, dimethylol urea, mucochloric acid, etc. Other emulsion adjuvants that may be added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

When polyethylene terephthalate is manufactured for use as a photographic support, the polymer is cast as a film, the mixed polymer subbing composition of Rawlins, U.S. Pat. No. 3,567,452 is applied and the structure is then biaxially stretched, followed by application of a gelatin subbing layer. Upon completion of stretching and the application of subbing compositions, it is necessary to remove strain and tension in the base by a heat treatment comparable to the annealing of glass. Air temperatures of from 100° C. to 160° C. are typically used for this heat treatment, which is referred to as the post-stretch heat relax.

The emulsions may be coated on the supports mentioned above as a single layer or multi-layer element. For medical X-ray applications, for example, where silver coating weights are generally high, layers of emulsion are coated on both sides of the support which conventionally contains a dye to impart a blue tint thereto. Contiguous to the emulsion layers it is conventional, and preferable, to apply a thin stratum of hardened gelatin supra to said emulsion to provide protection thereto.

DYE PREPARATION PROCEDURES

Dye 1

5-(3-methyl-2-benzothiazolinylidene)-rhodanine was made as follows:

3-methyl-2-(methylthio)benzothiazolium p-toluenesulfonate was first prepared by mixing 2-(methylthio)-benzothiazole (9.12 gm, 0.05 mol) with methyl p-toluenesulfonate (9.69 gm, 0.05 mol) and heating this mixture to 100° C. The reaction was exothermic at 150° C., where the temperature was maintained for 23 minutes. On cooling, the brown syrup crystallized. This material was washed and triturated with acetone until the washings were colorless. The yield was 16.1 gm of an off-white solid material (87% yield of theoretical) with a melting point of 166°–168° C.

3-methyl-2-(methylthio)benzothiazolium p-toluenesulfonate made above (11.01 gm, 0.03 mol) was dissolved in 75 ml of methanol and treated with 3.99 gm (0.03 mol) of rhodanine. Triethylamine (6.10 gm, 0.06 mol) was added thereto causing precipitation of the dye within 1 minute. Stirring continued overnight and the dye was then filtered and washed with methanol to yield 5.02 gm (60% of theoretical) of this dye.

Dye 2

5-(3-methyl-2-benzothiazolinylidene)-3-methylrhodanine was made as follows:

Triethylamine (21.1 ml) was condensed at −78° C. in dry ice and isopropanol and then added with stirring to ice-cooled 1,3-bromopropane (56.65 gm) in 135 ml of toluene. The solution hazed immediately but was allowed to stir for 2 and ½ days. A white precipitate of 3-(bromopropyl)trimethylammonium bromide was collected by filtration which, after drying, yielded 56.35 gm (87% yield) of this salt. The melting point was 203°–207° C. (dec.).

Solution A: 2-(methylthio)benzothiazole (72.48 gm, 0.04 mol) was placed in a preheated 160° C. oil bath. The mechanically stirred liquid was then heated to 151° C. before 104.4 gm (0.4 mol) of 3-(bromopropyl)trimethylammonium bromide was added thereto. The resulting paste yellowed, then liquified as the temperature rose again to 150° C. where methyl bromide evolution began. After 4 minutes, the mixture was cooled to a white wax which was then dissolved in 200 ml of methanol and designated as "Solution A".

3-methylrhodanine (8.84 gm, 0.06 mol) was dissolved in 49.4 gm of Solution A. Triethylamine (6.06 gm, 0.06 mol) was then added. Dye precipitation occurred immediately. After stirring an additional 45 minutes, the green-yellow dye was filtered and washed with methanol to yield 3.00 gm (17% of theoretical).

Dye 3

5-(3'-methyl-2-benzothazolinylidene)-3-ethylrhodanine was made as follows:

3-ethylrhodanine (3.2 gm, 0.02 mol) was added with stirring to 17.44 gm of Solution A from above. When all had dissolved, 2.02 gm (0.02 mol) of triethylamine was added thereto. The dye precipitated almost immediately but stirring continued another 45 minutes before filtering and washing with methanol to collect 0.96 gm. Addition of another 15.25 gm of Solution A resulted in the precipitation of 1.77 gm of additional dye for a total yield of 35% of theoretical.

Dye 4

5-(3-methyl-2-benzothiazolinylidene)-3-allylrhodanine was made as follows:

3-allylrhodanine (6.57 gm, 0.038 mol) was dissolved in 30.94 gm of Solution A from above. After filtering out the insolubles, 3.79 gm of triethylamine was added thereto. Dye immediately precipitated and was stirred for 20 minutes. The dye was then filtered and washed with methanol to give 2.22 gm (about 14% theoretical).

Dye 5

5-(3-methyl-2-benzothiazolinylidene)-3-carboxymethylrhodanine was made as follows:

2-(methylthio)benzothiazole (543.1 gm, 3.0 mol) was melted and mechanically stirred with 558.0 gm (3.0 mol) melted methyl p-toluenesulfonate and 1800 ml of xylene. The mixture was heated to reflux for seven hours. The reaction was then allowed to cool to room temperature before filtering. The filter cake was washed with acetone until the washings were colorless. The product was removed from the filter, stirred with 2000 ml of acetone for at least 1 hour, filtered again and washed with acetone until the washings were colorless. The dried solid (874.1 gm, 79% of theory), had a melting point of 173°-174° C.

This quaternary salt (807.8 gm, 2.2 mol) was slurried with 3500 ml of methanol and cooled to 4.5° C. Recrystallized rhodanine-3-acetic acid (426.4 gm, 202 mol) in 2000 ml of methanol cooled to 7° C. was added to this slurry. At 3° C., triethylamine (444 gm, 4.4 mol) was added dropwise from a funnel to maintain a reaction temperature below 5° C. The dye started precipitating after five minutes. After the triethylamine addition was complete, the reaction mixture was stirred an additional 5 hours, then filtered and washed with 4 liters of methanol. The dye was removed from the filter and stirred at least 1 hour at room temperature in 2–4 liters of methanol, filtered and partially dried. The solids were rewashed by stirring again at least 1 hour in 2–4 liters of methanol, filtered again and washed with water and methanol. The partially dried dye was slurried again in 4 liters of methanol. Then, a solution of 350 ml of concentrated HCl in 1650 ml of water was added. The slurry thickened and an additional 2500 ml of methanol added to facilitate stirring and dispersion of the solid. After 1 hour, the material was filtered, partially dried and reslurried in 6 liters of methanol for another hour. After filtering the solid, and washing twice with methanol, the dried, recovered dye yielded 545.6 gm (73% of theory).

Dye 6

5-(3-methyl-2-benzothiazolinylidene)-3-(2-carboxyethyl)rhodanine, triethylammonium salt, was made as follows:

A solution of 3.67 gm (0.01 mol) of 3-methyl-2-(thiomethyl)benzothiazolium p-toluenesulfonate in 25 ml of methanol was prepared. To this solution was added 20.5 gm, (0.01 mol) of 3-carboxyethylrhodanine. After all had dissolved, 20.3 gm (0.02 mol) of triethylamine was added thereto. The dye precipitated within 1 minute, but stirring continued for about 1.5 hours. Filtration of the solids, and methanol washing thereof, yielded 2.96 gm (65% of theory) of this dye.

Dye 7

5-(3-methyl-2-benzothiazolinylidene)-3-(β-sulfoethyl)-rhodanine was made as follows:

3-methyl-2-(methylthio)benzothiazolium p-toluenesulfonate (3.68 gm, 0.01 mol) made as above was slurried in 30 ml of methanol with 2.42 gm (0.01 mol) 3-β-sulfoethylrhodanine, which had been prepared by the method of Brooker, U.S. Pat. No. 2,493,748. Triethylamine (2.02 gm, 0.02 mol) was added followed by 100 ml of methanol. After stirring 3 hours, the precipitated dye was collected by filtration and washed with methanol to yield 3.14 gm (81% of theory).

Dye 8

5-(5-methoxy-3-methyl-2-benzothiazolinylidene)-3-carboxymethylrhodanine, triethylammonium salt, was made as follows:

5-methoxy-2-mercaptobenzothiazole (18.3 gm, 0.01 ml) was dispersed in 125 ml of 95% ethanol by volume. Addition of 10.1 gm (0.1 mol) of triethylamine gave a brown solution. Addition of iodomethane (14.2 gm, 0.1 mol) was slightly exothermic. Additional heating brought this mixture to reflux for 2 hours. After cooling, the residue was dispersed in isopropanol and filtered to remove triethylammonium iodide. The filtrate was mixed with water and the layers separated. The aqueous phase was extracted three times with methylene chloride. These organic portions were then combined, washed with brine and dried with sodium sulfate. Filtration and rotary evaporation gave 21.85 gm of a brown liquid which was distilled at 158°-162° C. (0.125 mm pressure) to give 16.73 gm (85% of theoretical) of 5-methoxy-2-(methylthio)benzothiazole. A mixture of 7 gm (0.033 mol) of this material and 6.77 gm (0.036 mol) of methyl p-toluenesulfonate were then heated to 128°-163° C. for 22 minutes. The resulting solid, after cooling, was triturated with acetone, filtered and acetone washed until the washings were colorless. This yielded 12.13 gm (96% of theoretical) of a quaternary salt. Rhodanine-3-acetic acid (1.91 gm, 0.01 mol) was then added to 3.97 gm (0.01 mol) of the quaternary salt in 25 ml of methanol. Triethylamine (2.22 gm, 0.02 mol) was then added, causing precipitation of the dye within 5 seconds and leading to the formation of a thick paste. Additional methanol (10 ml) was added to facilitate stirring which continued for 3.75 hours. Filtration and methanol washing of the solid yielded 4.19 gm (89% of theoretical) of this dye.

Dye 9

5-(5-chloro-3-methyl-2-benzothiazolinylidene)-3-carboxymethylrhodanine, triethylammonium salt, was made as follows:

5-chloro-2-(methylthio)benzothiazole was made by dissolving 5-chloro-2-mercaptobenzothiazole (10.16 gm, 0.05 mol) in 25 ml of 95% ethanol by volume. This solution was then treated with 5.09 gm (0.05 mol) of triethylamine to give a yellow solution. Addition of iodomethane (7.18 gm, 0.05 mol) caused an exothermic reaction to 60° C. Additional heat was applied to reflux the reaction mixture for 2.5 hours. Cooling yielded copious crystals which were filtered and washed with alcohol to yield 7.68 gm (71% of theory). The melting point of these solids was 70°-72° C. A mixture of 5.0 gm (0.023 mol) of this material and 4.40 gm of methyl-p-toluenesulfonate were heated to 152° C. for 7 minutes. On cooling, the mixture solidified and then was triturated with acetone to give 7.82 gm (84% of theory) of a salt with a melting point of 170°-185° C. This salt (3.51 gm, 0.0087 mol) was then slurried in 35 ml of methanol. Rhodanine-3-acetic acid (1.66 gm, 0.0087 mol) was then added followed by 1.76 gm (0.0174 mol) of triethylamine. A yellow-gold solution resulted. The dye precipitated therefrom after 30 seconds. After stirring for 2 hours, the dye was filtered and washed with methanol to give 2.63 gm (64% of theoretical).

Dye 10

5-(3-methyl-5-trifluromethyl-2-benzothiazolinylidene)-3-carboxymethylrhodanine, triethylammonium salt, was made as follows:

2-mercapto-5-trifluoromethylaniline hydrochloride (22.79 gm, 0.01 mol) was heated to reflux in 200 ml 95% ethanol by volume with 20 ml of 22% (by weight) aqueous potassium hydroxide and 16.0 gm (0.1 mol) of O-ethylxanthic acid, potassium salt. When hydrogen sulfide evolution had ceased, the solution was filtered, cooled and acidified with HCl. The initial precipitate was collected by filtration and discarded. The filtrate was allowed to stand to precipitate 13.79 gm (59% of theory) of desired product, with a melting point of 221°-222° C. The resulting 2-mercapto-5-trifluoromethylbenzothiazole (11.75 gm, 0.05 mol) was slurried in 50 ml of 95% ethanol, treated with 7.1 gm of triethylamine, and then refluxed 1 hour with 7.1 gm (0.05 mol) of iodomethane. The mixture was filtered hot, cooled, concentrated, and treated with water to precipitate 11.54 gm (93% of theoretical) of 2-methylthio-5-trifluoromethylbenzothiazole (melting point of 66°-69° C.). This compound (11.0 gm, 0.044 mol) was then heated to 130°-156° C. with 8.22 gm (0.044 mol) of methyl-p-toluenesulfonate for 5 minutes. After cooling, the resulting solid was washed and triturated with acetone to yield 15.05 gm (78% of theory) of 3-methyl-2-methylthio-5-trifluoromethyl-benzothiazolium p-toluenesulfonate with a melting point of 189°-191° C. This quaternary salt (4.35 gm, 0.01 mol) was dissolved with 1.91 gm (0.01 mol) of rhodanine-3-acetic acid in 20 ml of methanol. After 2.02 gm (0.02 mol) of triethylamine was added thereto, the mixture was stirred at room temperature for 4.5 hours before isolating the precipitated dye by filtration. After washing the filtered solid with methanol, 2.74 gm (54% of theoretical) of this dye was obtained.

Dye 11

5-(3-methyl-2-benzothiazolinylidene)-3-(α-carboxyethyl)-rhodanine, triethylammonium salt, was made as follows:

3-methyl-2-(methylthio)benzothiasolium p-toluenesulfonate (3.67 gm, 0.01 mol) made as described above, was slurried in 20 ml of methanol with 1.05 gm (0.01 mol) of 3-(α-carboxyethyl)-rhodanine, which had been prepared by the method of Brooker, U.S. Pat. No. 2,493,748. Triethylamine (2.02 gm, 0.01 mol) was then added. After stirring 4 hours, the precipitated dye was collected by filtration and washed with methanol to yield 1.35 gm (29% of the theoretical).

This invention will now be illustrated by the following examples, of which Example 1 is considered to be the best mode.

EXAMPLE 1

A silver bromide tabular emulsion was made according to the teachings of Ellis, Ser. No. 917,505, above. After precipitation of the grains the average aspect ratio was determined to be about 5:1 and thickness of about 0.2 μm. These grains were dispersed in photographic grade gelatin (about 117 grams gelatin/mole of silver bromide) and a suspension of 200 mg of Dye 5 in 25 ml of methanol added to achieve 133 mg of dye per mole of silver halide. At this point, the emulsion was brought to its optimum sensitivity with gold and sulfur salts as is well-known to those skilled in the art. The emulsion was then stabilized by the addition of 4-hydroxy-6-methyl-1,3,3a, 7-tetraazaindene and 1-phenyl-5-mercaptotetrazole. The usual wetting agents, antifoggants, coating aids and hardeners were added and this emulsion was then coated on a dimensionally stable, 7 mil polyethylene terephthalate film support which had first been coated with a conventional resin sub followed by a thin substratum of hardened gelatin applied supra thereto. These subbing layers were present on both sides of the support. The emulsion was coated on each side at about 2 g silver per square meter. A thin abrasion layer of hardened gelatin was applied over each of the emulsion layers. For control purposes, a similar emulsion was made without the dye of this invention. Samples of each of these coatings were given an exposure through a test target and a conventional step wedge to X-rays interacting with an X-ray intensifying screen and then developed in a conventional X-ray film processor. Evaluation of the samples are summarized as follows:

TABLE 1

| No. | Description | Fog | Rel. Speed |
|---|---|---|---|
| 1 | Control - No dye | 0.07 | 100 |
| 2 | Of this Invention | 0.12 | 190 |

No stain was noted in the sample containing the dye of this invention.

EXAMPLE 2

An emulsion similar to that of Example 1 was prepared and divided into 5 portions. Portion 1 (Control) contained no dye. A second control was employed using the following dye which is Compound 4, Table II of U.S. Pat. No. 4,439,520 at the same sensitization level as the dyes of this invention and it has the following structure:

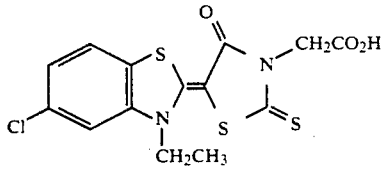

The remainder of the 3 portions contained dyes from those described above as indicated in Table 2, below. Samples of each emulsion was coated, exposed, and developed as described in Example 1 with the following results:

TABLE 2

| No. | Description | Dye Used | Fog | Speed |
|---|---|---|---|---|
| 1 | Control | None | 0.07 | 100 |
| 2 | " | Prior Art Dye | 0.07 | 89 |
| 3 | Of this Invention | 5 | 0.03 | 190 |
| 4 | " | 8 | 0.04 | 186 |
| 5 | " | 9 | 0.03 | 184 |

The speed of films prepared from emulsions containing the dyes of this invention had a greatly improved speed over controls without dye or with dyes of the prior art.

EXAMPLE 3

Additional emulsion was prepared as described in Example 1. Four samples of this emulsion were taken. Sample 1, the Control, contained no dye. Sample 2 contained Dye 5, above. Sample 3 contained another prior art zeromethine dye of the following structure:

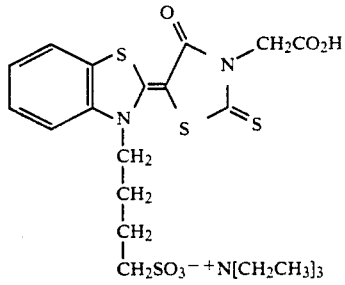

Dye B: 5-[3-(3'-sulfobutyl)-2-benzothiazolinylidene]-3-carboxymethylrhodanine, triethylammonium salt. Sample 4 contained both Dye 5 and Dye B. Films prepared from each emulsion were coated, exposed and developed as described in Example 1. Results are shown below:

TABLE 3

| No. | Description | Fog | Rel. Speed |
|---|---|---|---|
| 1 | Control - No dye | 0.07 | 100 |
| 2 | Dye 5 Alone | 0.12 | 190 |
| 3 | Dye B alone | 0.03 | 112 |
| 4 | Dye 5 + Dye B | 0.05 | 238 |

It is apparent from the above results that the addition of Dye B and Dye 5 in combination produces supersensitization and resulted in even greater spectral sensitivity in this tabular emulsion. Supersensitization of zeromethine merocyanine dyes of the present invention by another zeromethine merocyanine dye is wholly unexpected and has not been predicted by the prior art.

EXAMPLE 4

Other tabular emulsion containing varying levels of bromide and iodide as shown below in Table 4, were made according to the aforementioned Ellis teachings. After precipitation, the grains were measured by known methods and found to have an aspect ratios of about 5:1 and a thickness of about 0.22 μm. These grains were first sensitized with Dye 5, above, as taught in Example 1, and then brought to their optimum sensitivity with gold and sulfur salts as also taught therein. The remainder of the after-additions were indentical to Example 1. Each emulsion was coated on a film support, overcoated and dried. The testing procedure consisted of a blue light exposure from an electroluminescent unit to compare the relative sensitivities of each emulsion. The results obtained from this test are summarized below:

TABLE 4

| No. | Description | Fog | Rel. Speed |
|---|---|---|---|
| 1 | Control | 0.07 | 100 |
| 2 | No Iodide | 0.05 | 238 |
| 3 | 0.56% Iodide | 0.05 | 316 |
| 4 | 1.13% Iodide | 0.03 | 250 |
| 5 | 2.26% Iodide | 0.04 | 252 |

These results indicate that the procedures of this invention can be used to sensitize silver bromoiodide tabular emulsions.

What is claimed is:

1. In a photographic element comprising a support having at least one photosensitive, silver halide emulsion coated thereon, said emulsion comprising silver halide grains wherein at least 50% of said grains are tabular silver halide grains with a thickness of less than 0.5 microns and an average aspect ratio of greater than 2:1, dispersed in a binder, the improvement comprising incorporation into said emulsion a J-aggregating spectral sensitizing dye in the 400 to 500 nm range of the formula:

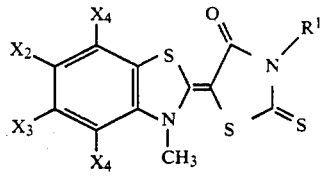

wherein each of $X_1$, $X_2$, $X_3$ and $X_4$ independently of the other is halogen, methoxy, hydrogen, trifluoromethyl, or alkyl of 1-3 carbon atoms and $R^1$ is $CH_2CO_2$—HN+$(CH_2CH_3)_3$,$CH_2$—$CO_2H$, $(CR''_2)_n$—$CO_2H$, or salt thereof wherein n is 1-5 and R'' is H or alkyl of 1-5 carbon atoms.

2. The element of claim 1 wherein the silver halide grains have a thickness of less than 0.3 microns.

3. The element of claim 1 wherein said tabular grains are silver bromide with an average aspect ratio in the range from 5:1 to 7:1.

4. The silver halide element of claim 1 wherein X1-4 are each H and R is $CH_2$—$CO_2H$ or its triethylamine salt.

5. The photographic element of claim 1 wherein the J-aggregating dye is selected from the group consisting of 5-(3-methyl-2-benzothiazolinylidene)-3-carboxymethylrhodanine, 5-(3-methyl-2-benzothiazolinylidene)-3-carboxymethylrhodanine triethylammonium salt 5-(3-methyl-2-benzothiazolinylidene)-3-(α-carboxyethyl)rhodanine, triethylammonium salt 5-(5-chloro-3-methyl-2-benzothiazolinylidene)-3-carboxymethylrhodanine, triethylammonium salt 5-(5-chloro-3-methyl-2-benzothiazolinylidene)-3-carboxymethylrhodanine, triethylammonium salt, and, 5-(3-methyl-5-trifluoromethyl-2-benzothiazolinylidene)-3-carboxymethylrhodanine, triethylammonium salt.

6. The element of claim 1 wherein the tabular grains are silver bromide said dye is present in said emulsion in a concentration range of 25 to 750 mg/mole of silver bromide.

7. The element of claim 1 wherein said emulsion additionally contains 5-[3-(-3'-sulfobutyl)-2-benzothiazolinylidene]-3-carboxymethylrhodanine.

8. A photographic X-ray element comprising a support with a coating on opposite sides thereof, said coating comprising an emulsion layer containing tabular silver iodobromide grains with a thickness of about 0.22 microns and an average aspect ratio of greater than 2:1 with the emulsion containing a J-aggregating spectral sensitizing dye in the 400 to 500 mm range comprising:

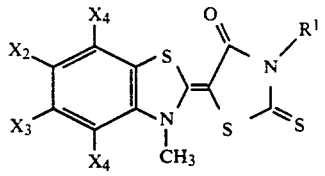

wherein each of $X_1$,$X_2$,$X_3$ and $X_4$ independently of the other is halogen, methoxy, hydrogen, trifluoromethyl, or alkyl of 1–3 carbon atoms and $R^1$ is $CH_2CO_2$—$HN^+(CH_2CH_3)_3$, $CH_2$—$CO_2H$, $(CR''_2)_n$—$CO_2H$, or salt thereof wherein n is 1–5 and R'' is H or alkyl of 1–5 carbon atoms.

* * * * *